US010000219B2

(12) United States Patent
Drexler et al.

(10) Patent No.: US 10,000,219 B2
(45) Date of Patent: Jun. 19, 2018

(54) RAIL VEHICLE WITH A COMPLETELY RETRACTABLE COUPLING

(71) Applicant: SIEMENS AKTIENGESELLSCHAFT, Munich (DE)

(72) Inventors: Stephan Drexler, Sauerlach (DE); Manuel Kroiss, Ebersbach (DE); Hannes Peer, Munich (DE); Christian Winkelmann, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 66 days.

(21) Appl. No.: 15/025,351

(22) PCT Filed: Sep. 27, 2013

(86) PCT No.: PCT/EP2013/070216

§ 371 (c)(1),
(2) Date: Mar. 28, 2016

(87) PCT Pub. No.: WO2015/043654

PCT Pub. Date: Apr. 2, 2015

(65) Prior Publication Data

US 2016/0214629 A1 Jul. 28, 2016

(51) Int. Cl.

| | |
|---|---|
| ***B61G 9/00*** | (2006.01) |
| ***B61G 9/20*** | (2006.01) |
| ***B61G 11/16*** | (2006.01) |

(52) U.S. Cl.

CPC ..... *B61G 9/20* (2013.01); *B61G 11/16* (2013.01)

(58) Field of Classification Search

CPC . B61G 9/00; B61G 9/20; B61G 11/16; B61G 11/18; B61G 11/12; B61G 11/14

See application file for complete search history.

(56) References Cited

U.S. PATENT DOCUMENTS 5,579,699 A * 12/1996 Dannawi ..... B60R 19/18 105/416
6,279,765 B1 * 8/2001 Monaco ..... B61G 9/08 188/269

(Continued)

FOREIGN PATENT DOCUMENTS

DE 19502217 A1 10/1996
DE 19705226 A1 8/1998

(Continued)

*Primary Examiner* — Jason C Smith

(74) *Attorney, Agent, or Firm* — Laurence Greenberg; Werner Stemer; Ralph Locher

(57) ABSTRACT

A rail vehicle has a bogie which rolls on a track in a direction of travel, a vehicle structure which is supported on the bogie, a rigid carrying structure which is arranged on the end side of the rail vehicle, and an end-side coupling opening through which a coupling extends for coupling further rail vehicles. A coupling securing device secures the coupling to the rail vehicle. The coupling securing device has reversible securing elements which permit a reversible lifting movement counter to the direction of travel to such an extent that the coupling is retracted completely into the supporting structure. As a result of the retraction of the coupling into the cage-like carrying structure it no longer influences the crash behavior.

12 Claims, 1 Drawing Sheet

(56) References Cited

U.S. PATENT DOCUMENTS

| | | | | |
|---|---|---|---|---|
| 6,845,874 | B2 * | 1/2005 | Payne | B61F 19/06 105/392.5 |
| 7,597,051 | B2 | 10/2009 | Gough | |
| 7,708,157 | B2 * | 5/2010 | Kemper | B61D 15/06 213/57 |
| 8,141,497 | B2 | 3/2012 | Kwon et al. | |
| 2005/0145591 | A1 * | 7/2005 | Mattschull | B61G 7/12 213/75 R |
| 2007/0186802 | A1 * | 8/2007 | Gough | B61D 15/06 105/392.5 |
| 2007/0261592 | A1 * | 11/2007 | Mochida | B61D 15/06 105/392.5 |
| 2016/0214629 | A1 * | 7/2016 | Drexler | B61G 11/16 |
| 2016/0221587 | A1 * | 8/2016 | Drexler | B61D 15/06 |

FOREIGN PATENT DOCUMENTS

| | | | | |
|---|---|---|---|---|
| DE | 19805287 | A1 * | 8/1999 | B61G 7/10 |
| DE | 19805287 | A1 | 8/1999 | |
| EP | 0243758 | A2 | 11/1987 | |
| EP | 0831005 | A2 | 3/1998 | |
| EP | 1582428 | A1 | 10/2005 | |
| EP | 1900593 | A2 * | 3/2008 | B61D 15/06 |
| EP | 1905661 | A1 | 4/2008 | |
| EP | 1955918 | A1 | 8/2008 | |
| EP | 1900593 | B1 | 10/2010 | |
| RU | 97975 | U1 | 9/2010 | |
| WO | 2005028275 | A1 | 3/2005 | |
| WO | 2008029970 | A1 | 3/2008 | |
| WO | WO-2008029970 | A1 * | 3/2008 | B61D 15/06 |
| WO | 2012171714 | A1 | 12/2012 | |

* cited by examiner

RAIL VEHICLE WITH A COMPLETELY RETRACTABLE COUPLING

BACKGROUND OF THE INVENTION

Field of the Invention

The invention relates to a rail vehicle with an end-side coupling for coupling further rail vehicles.

Rail vehicles must satisfy predefined safety requirements in order to ensure the safety of a person in the engineer's cab in the event of a collision. In addition it is advantageous if the damage occurring in the event of more minor collisions can be limited as much as possible. Because of this, rail vehicles are equipped with crash equipment, which has reversible and irreversible energy absorption elements arranged on the front side which permit a controlled dissipation of the kinetic energy of the vehicles involved in the collision.

EP 1 900 593 B1 discloses a rail vehicle with such crash equipment, wherein the crash equipment comprises a vehicle coupling with an energy absorber, two side buffers and a guard iron. However, the vehicle coupling appreciably affects the crash behavior of the rail vehicle, in particular when the coupling has absorbed the maximum possible collision energy.

EP 0 243 758 A2 discloses a rail vehicle with an automatic train coupling which is embodied such that the spring characteristic of the side buffers is affected by it as little as possible. The principle proposed there can however be deployed only in the case of more minor collisions.

From EP 1 582 428 A1 a rail vehicle is known with an energy absorption element which is provided with a ride-up protection device. The energy absorption element is arranged on the end side and a support structure which is offset rearward in the direction of travel projects over it at height.

BRIEF SUMMARY OF THE INVENTION

The object of the invention is to provide a rail vehicle in which in the event of a collision the coupling has as little effect as possible on the crash behavior of the rail vehicle.

The invention achieves this object by a rail vehicle with a bogie which rolls on a trackway in a direction of travel, a vehicle structure which is supported on the bogie, a rigid support structure which is arranged on the end side of the vehicle and has an end-side coupling opening through which a coupling extends for coupling further rail vehicles, and a coupling securing means for securing the coupling to the rail vehicle, wherein the coupling securing means have reversible securing elements which permit a reversible lifting movement of the coupling counter to the direction of travel such that the coupling is retracted completely into the supporting structure.

According to the invention a rail vehicle is provided which on its end side has a rigid support structure. The support structure is for example arranged centrally in the transverse direction of the rail vehicle and is fitted with an end-side cage jaw or in other words with an end-side coupling opening, through which extends a coupling which can be subject to tension and compression. Here the support unit is expediently arranged in the transverse direction centrally on the end side of the rail vehicle, wherein in normal operation in a plan view in the direction of travel the coupling projects over it. In the event of a collision the front end of the coupling therefore initially comes into contact with the other vehicle involved in the collision, wherein because of the coupling securing means with their reversible securing elements a reversible lifting movement counter to the direction of travel is permitted such that the coupling retracts completely into the rigid support structure. In other words the free end of the coupling, for example the coupling head, arranged in front in the direction of travel in a plan view of the rail vehicle, terminates flush with the rigid support structure. The crash behavior is hence no longer partly determined by the coupling in the context of the invention. Because of the rigid support structure, into which the coupling retracts in the event of a collision, disadvantageous effects are therefore precluded.

The coupling is preferably an automatically coupling train coupling. Train couplings can be subject to both compression and tension. When subject to compression the result is, as already explained, the reversible deflection of the coupling counter to the direction of travel until finally the coupling is completely retracted into the supporting structure.

According to a preferred embodiment of the invention the coupling securing means can be subject to tension and compression and have an internal hollow securing sleeve, into which a securing plunger projects and is supported in the securing sleeve by spring means. Obviously coupling securing means different from this can also be used in the context of the invention. The securing plunger has connection means for permanent connection with the coupling.

According to a preferred embodiment of the invention the supporting structure has ride-up protection means, which in the event of a collision with an obstacle or another vehicle prevent the rail vehicle from riding up over the obstacle or vice versa.

Advantageously the supporting structure has a plateau section, which is part of the vehicle structure, wherein arranged underneath the plateau section is a guard iron receiver for securing a guard iron, and which is permanently connected to the plateau section. According to this advantageous development the supporting structure also serves to fasten a guard iron, which ensures that no objects lying on the track pass under the rail vehicle. Since the supporting structure is part of the vehicle structure, the overall construction is particularly robust. In this case the supporting structure can readily be integrated into the vehicle structure, for example as an integrally formed component. Assembly is hence simpler and thus more economical in the context of the invention.

As already explained, the supporting structure can be fitted with ride-up protection means. These ride-up protection means are for example arranged on an end-side surface of the plateau section of the supporting structure. The end-side surface is turned forward in the direction of travel.

The plateau section advantageously extends across the entire width of the rail vehicle and can then be permanently integrated into the vehicle structure as a transverse support. Additionally however the plateau section also extends in the longitudinal direction, wherein the securing means likewise extend in the longitudinal direction, so that a force-fit connection is provided in the longitudinal direction between plateau section and securing means. This connection ensures a high bending moment. The longitudinal direction coincides with the direction of travel.

Advantageously the guard iron receiver is connected to the plateau section by way of securing means, wherein the securing means, the plateau section and the guard iron receiver form a coupling cage, the end side of which delimits the coupling opening. The coupling cage thus provides stops for the coupling at its end side. According to this advantageous development of the invention the cage-like supporting structure also serves to delimit the movement of the coupling, which extends for example as a central coupling underneath the plateau section out of the coupling cage delimited by the plateau section, the securing means and the guard iron receiver.

Expediently the coupling cage forms a jacking position, wherein the support unit exhibits a stability such that jacking of the rail vehicle at the jacking position is permitted. The jacking position is expediently an upper section of the coupling cage, which for example is fitted with a reinforcement profile on its side facing the plateau section. The said reinforcement profile is for example part of the plateau section. In deviation from this, the reinforcement profile is arranged with a small clearance underneath the plateau section and extends between the securing means which form lateral delimiting walls for the coupling cage. Thanks to the jacking position the rail vehicle can be easily rerailed.

Advantageously the ride-up protection means are embodied as ribs which project out of an end face of the plateau section facing forward in the direction of travel. In the event of a collision the end-side forward-projecting ribs engage with possibly correspondingly embodied ride-up protection means on the other vehicle involved in the collision, so that riding-up is precluded as a result of these locking ribs. The said ribs extend horizontally or in other words in the transverse direction and parallel to a plane defined by the wheel touchdown points.

Expediently the plateau section extends in the longitudinal and transverse direction, so that a horizontal surface is formed, on the underside of which the securing means are fixed. Because of this flat embodiment of the plateau section the entire construction of the supporting structure can provide a high bending moment and thus exhibit high stability despite a low mass. Therefore strong forces can be absorbed by the supporting structure.

According to an expedient development in this respect the securing means are embodied as reinforcement plates which extend perpendicular to the track, wherein side walls are formed in sections. The perpendicular sections of the securing means thus delimit the coupling cage laterally, wherein they can extend across the entire length of the plateau section. The reinforcement plates are aligned forward in the direction of travel with their flat sides, in other words their edges, wherein the front edges extend from the guard iron receiver upward to the plateau section. In this case further reinforcement ribs, which are attached for example in the interior of the coupling cage to the respective side wall sections, can be used. The said reinforcement ribs are for example also connected to the guard iron receiver and to the underside of the plateau section.

Additionally other such profile supports can also be provided to reinforce the support unit in the context of the invention.

Advantageously the supporting structure protrudes over at least one energy absorption element in the direction of travel. According to this advantageous development the rail vehicle is fitted with energy absorption elements, which however are arranged offset rearward on the rail vehicle opposite the supporting structure counter to the direction of travel. These energy absorption elements hence come into play only if the collision object has projecting sections which protrude over the supporting structure, so that in a collision the supporting structure passes under these projecting sections of the other vehicle involved in the collision. The said energy absorption elements arranged above the supporting structure are for example irreversible energy absorption elements, which for example are plastically deformable or the components of which scrape against one another in a collision, wherein the motive energy to be absorbed is dissipated in a controlled manner.

According to an expedient development in this respect the supporting structure has at its uppermost point a clearance from a plane defined by the wheel touchdown points of the bogie of less than 1500 mm. This maximum height of the supporting structure has proven to be advantageous in that projecting components of the other vehicle involved in the collision overlap the supporting structure in the event of a collision.

Other expedient embodiments and advantages of the invention are the subject of the following description of an exemplary embodiment of the invention with reference to the figures in the drawing, wherein identical reference characters refer to components with an identical effect and wherein

DESCRIPTION OF THE INVENTION

Figure 1:
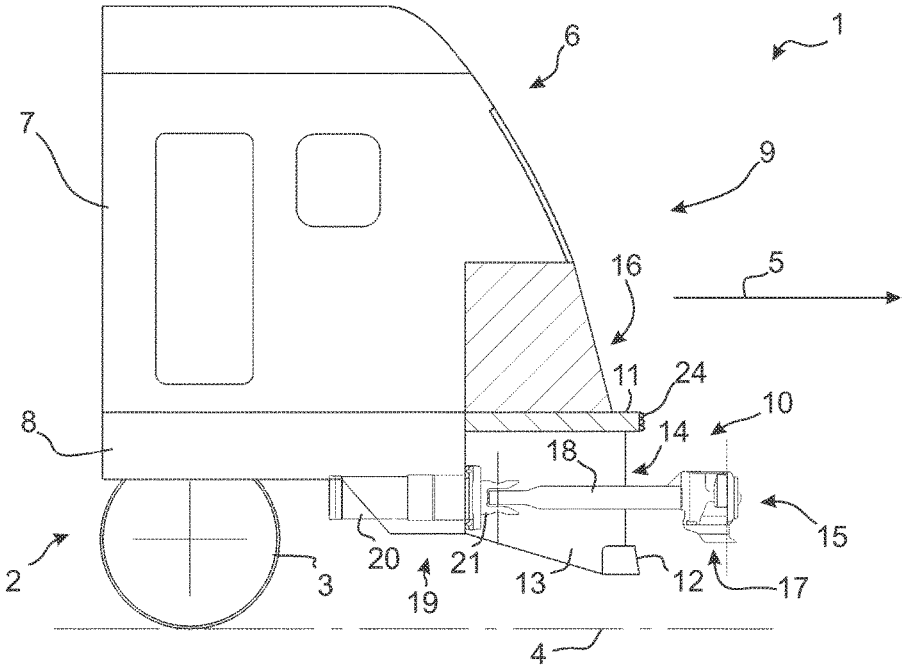
FIG. 1 shows a partially sectional side view of an exemplary embodiment of the inventive rail vehicle with extended coupling and FIG. 2 shows the rail vehicle according to FIG. 1 with retracted coupling.
Figure 2:
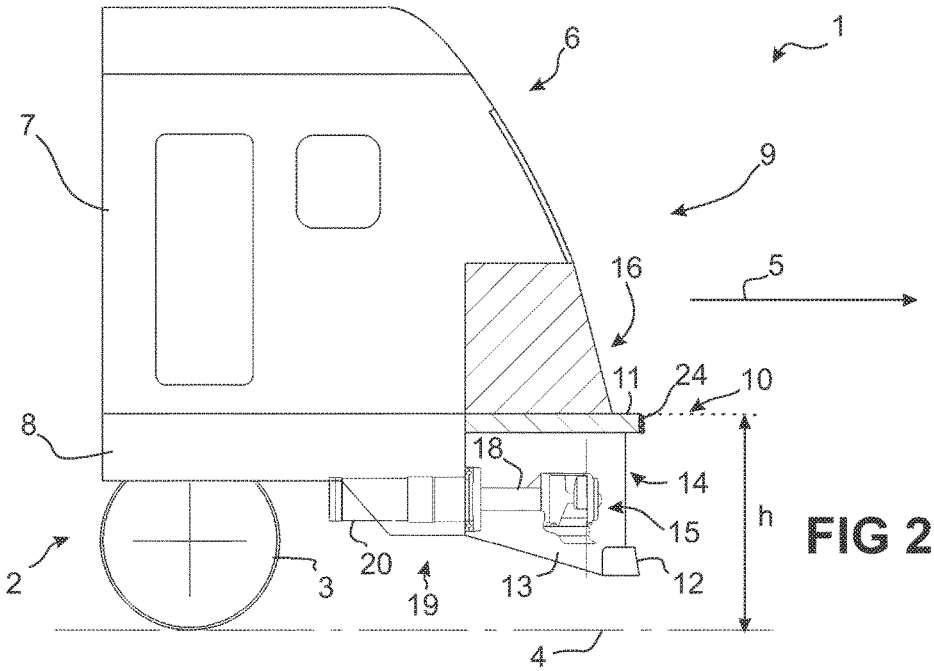

FIG. 1 shows an exemplary embodiment of the inventive rail vehicle 1 in a partially sectional side view. The rail vehicle 1 has a bogie 2, of which only one wheel 3 of a wheel axle of a bogie truck is identifiable in the figures. The wheel 3 is supported on rails 4 to permit it to roll, wherein in FIGS. 1 and 2 it moves in a direction of travel 5. Two rails 4 running parallel to one another define a trackway for the rail vehicle 1. The contact point between rail and wheel is designated here as a wheel touchdown point. Supported on the bogie 2 is a vehicle structure 6 which has a vehicle body 7 which has a baseframe, of which a sole bar 8 is illustrated in the figure. The baseframe further has transverse supports (not identifiable in the side view illustrated) which run horizontally and at right angles to the sole bar. On the front of the rail vehicle 1 or in other words on its end side 9 a rigid support structure 10 can be recognized, which has a plateau section 11 and a guard iron receiver 12. The guard iron receiver 12 is permanently connected to the plateau section 11 by way of securing means 13, wherein on the end side a circumferentially closed delimited coupling opening 14 is formed by the plateau section 11 of the guard iron receiver 12 and the securing means 13, and through which a coupling 15 extends. The plateau section 11 runs both in the longitudinal direction matching the direction of travel 5 and also at right angles thereto in the said horizontal transverse direction. The securing means extend perpendicular thereto and in the longitudinal direction, so that the supporting structure forms a coupling cage. For connection with the plateau section 11 the securing means 13 are for example welded to the latter and to the guard iron receiver 12 or are otherwise permanently connected. The supporting structure 10 is therefore a rigid supporting structure 10 and because of its cage-like and spatial embodiment has a high bending moment.

The guard iron receiver 12 serves to attach a guard iron (not illustrated in the figures) which is secured with a small clearance above the rails 4 and therefore above a plane formed by the wheel touchdown points of the rail wheels 3.

Arranged above the supporting structure 10 on the end side of the rail vehicle are energy absorption elements 16 which when an external force is applied can be plastically deformed and therefore provide collision protection.

The coupling 15 is embodied as a central coupling which can be subject to tension and compression. In other words the supporting structure 10 too is arranged in the transverse direction centrally on the end side 9 of the rail vehicle 1. The coupling 15 has a coupling head 17 which projects out of the supporting structure in the direction of travel and which is secured on the rail vehicle 1 by a coupling securing means 19 by way of a coupling rod 18. The coupling securing means 19 is here mounted permanently on the vehicle body 7 and therefore on the vehicle structure 6. It can likewise be subject to tension and compression and has an internally hollow beaker-shaped securing sleeve 20, into which a securing plunger 21 extends with its support end, which is not identifiable in the figures. Facing away from the support end, the securing plunger 21 has a clamping jaw which engages with the coupling rod 18.

The coupling securing means 19 can be subject to tension and compression, wherein they permit a reversible displacement of the coupling 15 counter to the direction of travel 5 such that this is completely retracted in the supporting structure 10. This completely retracted position of the coupling 15 is identifiable in FIG. 2. It is clarified here that the coupling head 17 and therefore the front end (in the direction of travel 5) of the coupling 15 is retracted completely behind the delimitation of the coupling opening 14. A detrimental effect of the coupling 15 on the crash behavior of the rail vehicle 1 is therefore precluded.

The uppermost position of the supporting structure 10, in other words therefore the upper end of the plateau section 11, has a clearance h of 1450 mm to the rail 4. In a collision the supporting structure 10 hence generally runs under protuberant collision regions of the collision object counter to the direction of travel 5 in the longitudinal direction, so that the energy absorption elements 16 arranged above the supporting structure 10 can come into play.

To prevent riding-up the plateau section 11 is fitted on its front end side with ride-up protection means, here in the form of ribs 24. In a collision the ribs 24 engage with correspondingly embodied ribs or ride-up protection means different therefrom on the other vehicle involved in the collision, thereby to the greatest possible extent preventing the vehicles involved in the collision from riding up over one another and therefore preventing the rail vehicle 1 from being derailed.

The invention claimed is:

1. A rail vehicle, comprising:

a bogie for rolling on a track in a direction of travel;

a vehicle structure supported on said bogie;

a rigid support structure disposed at an end side of the rail vehicle and having an end-side coupling opening;

a coupling extending through said end-side coupling opening for coupling further rail vehicles;

a coupling securing device for securing said coupling to the rail vehicle, said coupling securing device having reversible securing elements configured to permit a reversible stroke movement counter to the direction of travel to thereby completely retract said coupling in said support structure for precluding detrimental effects of said coupling on a crash behavior of the rail vehicle.

2. The rail vehicle according to claim 1, wherein said coupling is an automatically coupling train coupling.

3. The rail vehicle according to claim 1, wherein said coupling securing device is configured to be subject to tension and compression, and said securing device has an internally hollow securing sleeve into which a securing plunger projects, and wherein said securing plunger is supported in said securing sleeve by a spring.

4. The rail vehicle according to claim 1, wherein said supporting structure includes a ride-up protection device which, in the event of a collision with an obstacle, prevents the rail vehicle from riding up over the obstacle or vice versa.

5. The rail vehicle according to claim 1, wherein said supporting structure comprises a plateau section which is part of said vehicle structure, and further comprising a guard iron receiver arranged underneath said plateau section for securing a guard iron that is permanently connected to said plateau section.

6. The rail vehicle according to claim 5, wherein said guard iron receiver is connected to said plateau section by a further securing device, wherein said further securing device, said plateau section and said guard iron receiver form a coupling cage which delimits said coupling opening on the end side.

7. The rail vehicle according to claim 6, wherein said coupling cage forms a jacking position, and wherein said support structure has a stability to permit a jacking up of the rail vehicle at the jacking position.

8. The rail vehicle according to claim 5, wherein said supporting structure includes ribs forming a ride-up protection device which, in the event of a collision with an obstacle, prevents the rail vehicle from riding up over the obstacle or vice versa, and wherein said ribs project out of a front end face of said plateau section.

9. The rail vehicle according to claim 5, wherein said plateau section extends in a longitudinal direction and a transverse direction, so that a horizontal surface is formed, and wherein said securing device is mounted to an underside of said horizontal surface.

10. The rail vehicle according to claim 5, wherein said securing device includes reinforcement plates, which form perpendicular side wall sections.

11. The rail vehicle according to claim 1, which comprises energy absorption elements at a head end of the rail vehicle, wherein said supporting structure projects beyond said energy absorption elements in the direction of travel.

12. The rail vehicle according to claim 11, wherein an uppermost point of said supporting structure has a clearance h of less than 1500 mm from a plane defined by wheel contact points at which wheels of said bogie are in contact with rails of the track.

* * * * *